US010724697B2

(12) United States Patent
Yu et al.

(10) Patent No.: US 10,724,697 B2
(45) Date of Patent: Jul. 28, 2020

(54) ELECTRIC FIREPLACE

(71) Applicant: NINGBO HOMSTAR ELECTRICAL CO., LTD., Cixi (CN)

(72) Inventors: Aijun Yu, Cixi (CN); Feng Chen, Cixi (CN)

(73) Assignee: NINGBO HOMSTAR ELECTRICAL CO., LTD., Cixi (CN)

( * ) Notice: Subject to any disclaimer, the term of this patent is extended or adjusted under 35 U.S.C. 154(b) by 0 days.

(21) Appl. No.: 16/309,114

(22) PCT Filed: Jul. 27, 2017

(86) PCT No.: PCT/CN2017/094675
§ 371 (c)(1),
(2) Date: Dec. 12, 2018

(87) PCT Pub. No.: WO2018/040810
PCT Pub. Date: Mar. 8, 2018

(65) Prior Publication Data

US 2019/0331307 A1 Oct. 31, 2019

(30) Foreign Application Priority Data

Aug. 30, 2016 (CN) ..... 2016 2 0978378 U

(51) Int. Cl.
*F21S 10/04* (2006.01)
*F24C 7/00* (2006.01)

(52) U.S. Cl.
CPC ..... *F21S 10/04* (2013.01); *F24C 7/004* (2013.01)

(58) Field of Classification Search
CPC ..... F21S 10/04; F24C 7/004
USPC ..... 362/92; 40/428
See application file for complete search history.

(56) References Cited

U.S. PATENT DOCUMENTS

| | | | | |
|---|---|---|---|---|
| 3,603,013 A | | 9/1971 | Reed et al. | |
| 3,978,598 A | * | 9/1976 | Rose | F21S 10/04 40/428 |
| 7,236,693 B2 | * | 6/2007 | Haugom | F24C 7/004 362/227 |
| 7,334,360 B1 | * | 2/2008 | Corry | G09F 19/12 40/428 |
| 8,739,439 B2 | * | 6/2014 | Asofsky | F24C 7/004 40/428 |

(Continued)

FOREIGN PATENT DOCUMENTS

| | | |
|---|---|---|
| CN | 205919249 U | 2/2017 |
| GB | 0808626.6 A | 11/2009 |

*Primary Examiner* — Julie A Bannan
(74) *Attorney, Agent, or Firm* — Bayramoglu Law Offices LLC

(57) ABSTRACT

An electric fireplace includes a shell, where a heating component including a wind turbine and a heating element is disposed in the shell, and further includes a translucent imaging screen, where the imaging screen is vertically disposed at an upper end of the shell, a flame plate that can cast a flame shape is disposed on an upper end surface of the shell, and a light source and a light interference combination that includes a light interference barrel and a motor are disposed below the flame plate. Disposing the imaging screen externally greatly reduces the size of the shell. The present utility model is small in size, convenient in transportation, and unique in model, and can be adapted to a modern decoration style.

5 Claims, 3 Drawing Sheets

(56) References Cited

U.S. PATENT DOCUMENTS

| | | | | |
|---|---|---|---|---|
| 2005/0072031 | A1* | 4/2005 | Hess | F24C 7/004<br>40/428 |
| 2010/0229849 | A1* | 9/2010 | Asofsky | F24C 7/004<br>126/500 |
| 2018/0363870 | A1* | 12/2018 | Jones | F24B 1/1808 |

* cited by examiner

ELECTRIC FIREPLACE

CROSS REFERENCE TO RELATED APPLICATIONS

This application is the national phase entry of International Application No. PCT/CN2017/094675, filed on Jul. 27, 2017, which is based upon and claims priority to Chinese Patent Application No. 201620978378.3, filed on Aug. 30, 2016, the entire contents of which are incorporated herein by reference.

TECHNICAL FIELD

The present utility model relates to an electric fireplace.

BACKGROUND

Currently, a fireplace in the market is supported by a huge cabinet, and an imaging plate, a heating component, and a light cast component are disposed inside the cabinet. Consequently, the fireplace has an excessively large size and high transportation costs. The huge cabinet of the fireplace causes a complex integral model, usually including retro models. Therefore, it is difficult to match a modern simple house design style.

SUMMARY

To overcome a disadvantage in the prior art that an electric fireplace cannot match a modern simple house design style because disposing an imaging screen of the electric fireplace internally causes an excessively large size and a complex model, the present utility model provides an electric fireplace.

A technical solution for the present utility model to resolve the technical problem is: an electric fireplace, including a shell, where a heating component including a wind turbine and a heating element is disposed in the shell, and further including a translucent imaging screen, where the imaging screen is vertically disposed at an upper end of the shell, a flame plate that can cast a flame shape is disposed on an upper end surface of the shell, and a light source and a light interference combination that includes a light interference barrel and a motor are disposed below the flame plate. Disposing the imaging screen externally greatly reduces the size of the shell.

Further, the light source is disposed below the light interference barrel, and the light source images light onto the imaging screen through the light interference barrel and the flame plate sequentially.

Further, an air outlet is disposed on one side of the flame plate.

Further, an inner wind shield and an outer wind shield are disposed inside the air outlet of the flame plate, and an air outlet of the heating component is disposed between the inner wind shield and the outer wind shield.

Further, the imaging screen is vertically disposed on the middle of the flame plate, and the flame plate is further covered with a panel.

Further, an air inlet is disposed on the other side of the flame plate, the shell is a cuboid, and the air inlet and the air outlet are disposed on chamfers on two sides of the upper end of the shell. A knob for adjusting a wind quantity is disposed at one end of the cuboid shell.

When the present utility model is used, after being switched on, the light source emits light through the light interference barrel onto the flame plate, a flame shape is cast onto the imaging screen after the light is shaped by the flame plate, and the rotation of the motor drives the light interference barrel to rotate, to make the flame flicker, and present different forms. Meanwhile, the heating component works and blows out a hot wind from the air outlet, so that the user can feel heat as if the heat is from a flame. The imaging screen may be detached for transportation, greatly increasing product transportation efficiency.

The present utility model has beneficial effects of small size, convenient transportation and distinct design, and can adapt to modern decoration styles.

DETAILED DESCRIPTION

The following further describes the present utility model in detail with reference to the accompanying drawings and specific implementations.

Figure 1:
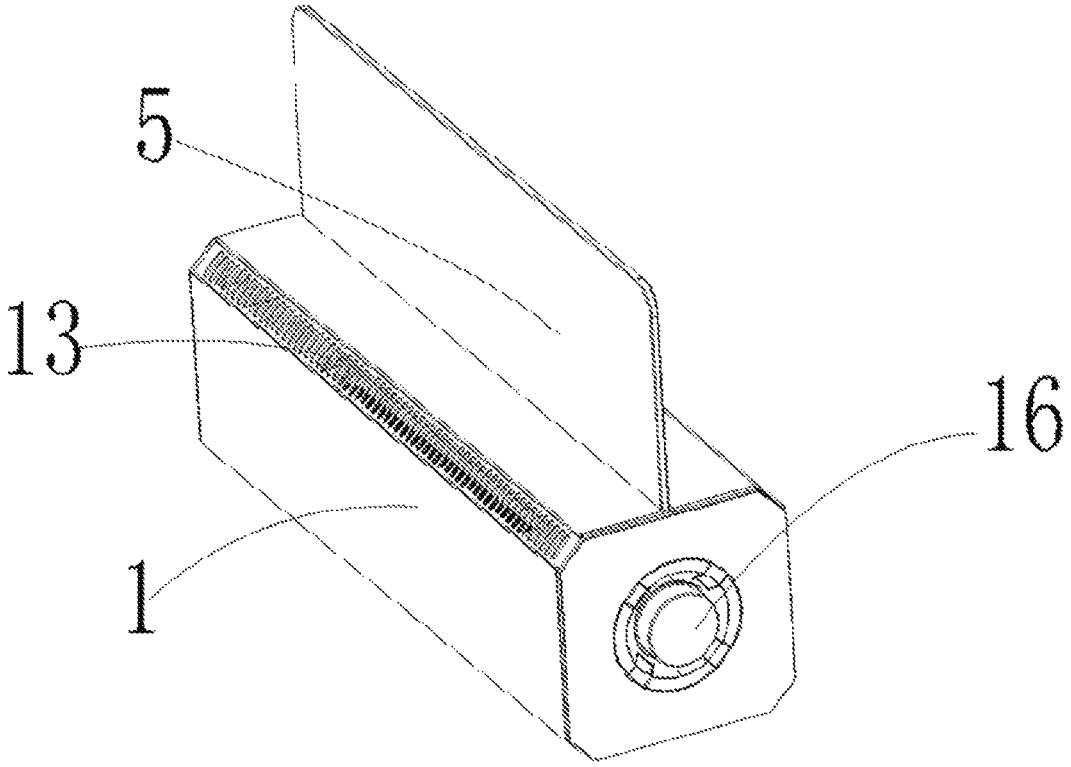
FIG. 1 is a three-dimensional view of the present utility model.
Figure 2:
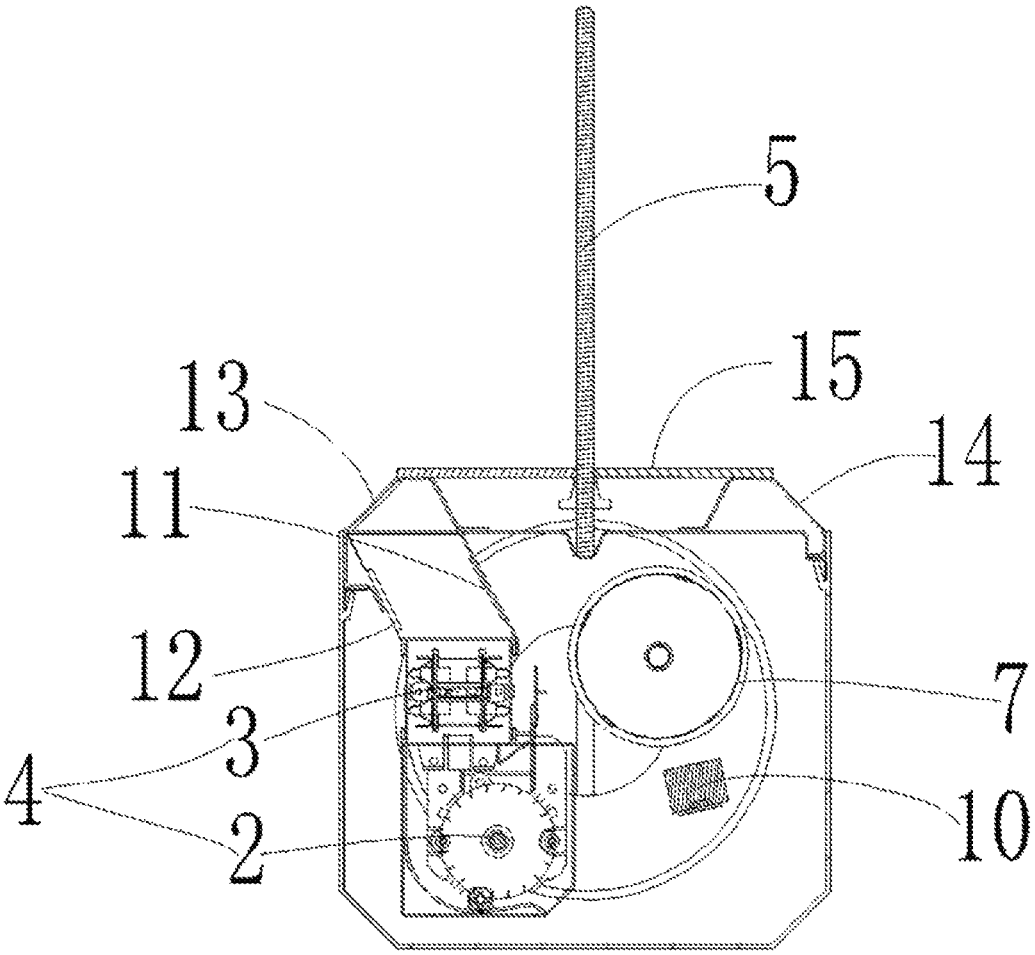
FIG. 2 is a sectional view of the present utility model.
Figure 3:
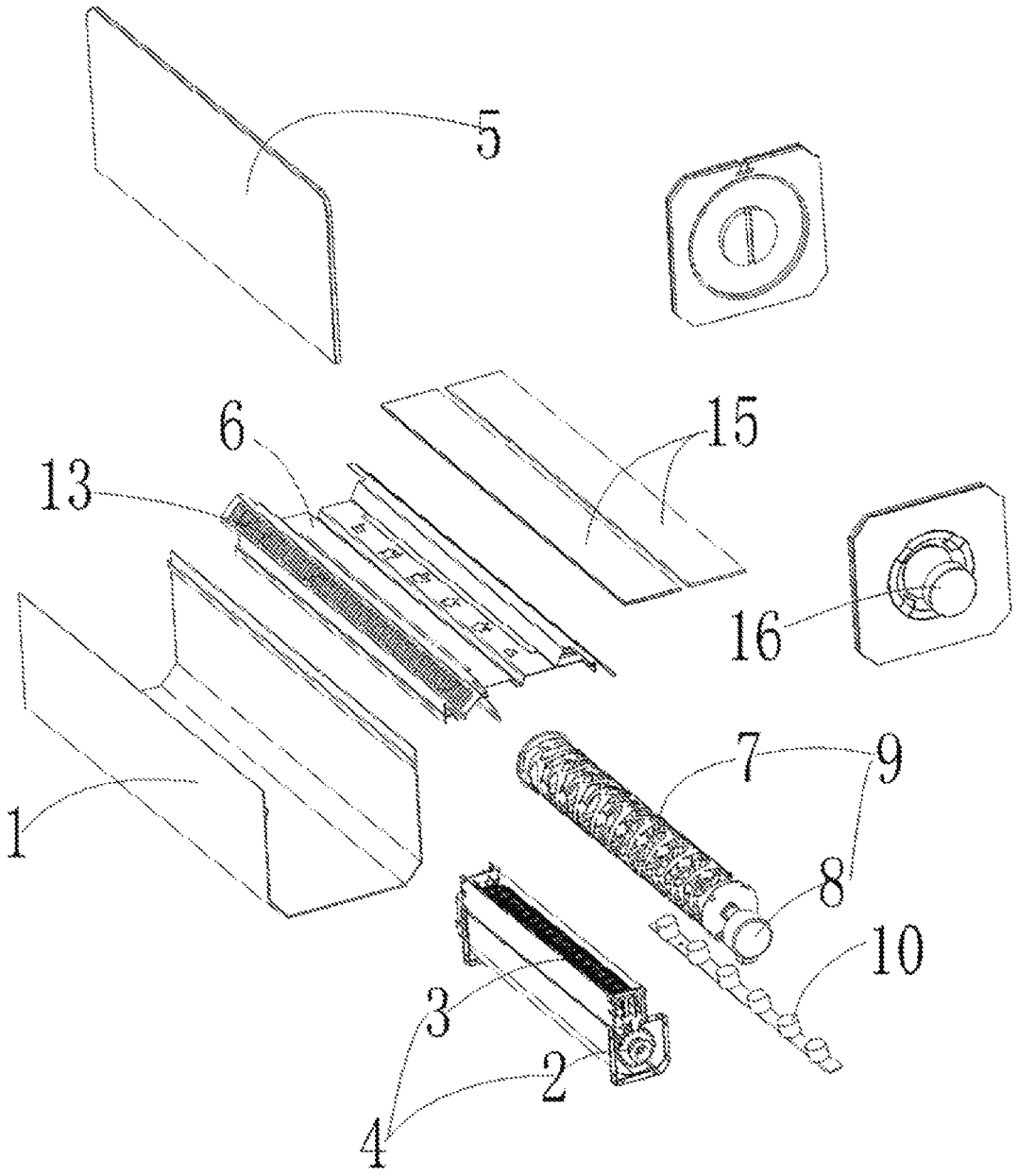
FIG. 3 is an exploded view of the present utility model.

As shown in FIG. 1 to FIG. 3, an electric fireplace includes a shell 1, where a heating component 4 including a wind turbine 2 and a heating element 3 is disposed in the shell 1, and further includes a translucent imaging screen 5, where the imaging screen 5 is vertically disposed at an upper end of the shell 1, a flame plate 6 that can cast a flame shape is disposed on an upper end surface of the shell 1, and a light source 10 and a light interference combination 9 that includes a light interference barrel 7 and a motor 8 are disposed below the flame plate 6. Disposing the imaging screen 5 externally greatly reduces the size of the shell.

In this embodiment, the light source is disposed below the light interference barrel 7, and the light source images light onto the imaging screen through the light interference barrel and the flame plate sequentially.

In this embodiment, an air outlet 13 is disposed on one side of the flame plate 6.

In this embodiment, an inner wind shield 11 and an outer wind shield 12 are disposed inside the air outlet of the flame plate 6, and an air outlet of the heating component is disposed between the inner wind shield 11 and the outer wind shield 12.

In this embodiment, the imaging screen is vertically disposed on the middle of the flame plate, and the flame plate is further covered with a panel 15.

In this embodiment, an air inlet 14 is disposed on the other side of the flame plate 6, the shell 1 is a cuboid, and the air inlet 14 and the air outlet 13 are disposed on chamfers on two sides of the upper end of the shell 1. A knob 16 for adjusting a wind quantity is disposed at one side of the cuboid shell. In this embodiment, the position of the air inlet is not limited to a chamfer, and may be at either end of a side surface or a bottom surface according to different model designs; and the shape of the shell is also not limited to a cuboid, and may also be a long strip shape such as a cylinder or an ellipsoid.

When the present utility model is used, after being switched on, the light source 10 emits light through the light interference barrel 7 onto the flame plate 6, a flame shape is cast onto the imaging screen 5 after the light is shaped by the flame plate 6, and the rotation of the motor 8 drives the light interference barrel 7 to rotate, to make the flame flicker, and present different forms. Meanwhile, the heating component works and blows out a hot wind from the air outlet, so that the user can feel heat as if the heat is from a flame. The imaging screen may be detached for transportation, greatly increasing product transportation efficiency.

What is claimed is:

1. An electric fireplace, comprising:

a shell;

a heating component comprising a wind turbine and a heating element is disposed in the shell;

an imaging screen, wherein the imaging screen is vertically disposed at an upper end of the shell;

a flame plate to cast a flame shape is disposed on an upper end surface of the shell; a light source; and a light interference combination comprising a light interference barrel and a motor;

wherein, the light source and the light interference combination are disposed below the flame plate, wherein the imaging screen is vertically disposed in a middle of the flame plate, and the flame plate is covered with a panel.

2. The electric fireplace according to claim 1, wherein the light source is disposed below the light interference barrel, and light source images light onto the imaging screen through the light interference barrel and the flame plate sequentially.

3. The electric fireplace according to claim 1, wherein an air outlet is disposed on one side of the flame plate.

4. The electric fireplace according to claim 3, wherein an inner wind shield and an outer wind shield are disposed inside the air outlet of the flame plate, and an air outlet of the heating component is disposed between the inner wind shield and the outer wind shield.

5. The electric fireplace according to claim 3, wherein an air inlet is disposed on an other side of the flame plate, the shell is a cuboid, and the air inlet and the air outlet are disposed on chamfers on two sides of the upper end of the shell.

* * * * *